US010667611B1

(12) United States Patent
Kahl

(10) Patent No.: US 10,667,611 B1
(45) Date of Patent: Jun. 2, 2020

(54) ACTIVE SEATING APPARATUS

(71) Applicant: Fully LLC, Portland, OR (US)

(72) Inventor: David Kahl, Portland, OR (US)

(73) Assignee: Fully LLC, Portland, OR (US)

( * ) Notice: Subject to any disclaimer, the term of this patent is extended or adjusted under 35 U.S.C. 154(b) by 0 days.

(21) Appl. No.: 16/271,724

(22) Filed: Feb. 8, 2019

(51) Int. Cl.
*A47C 3/34* (2006.01)
*A47C 3/029* (2006.01)

(52) U.S. Cl.
CPC ..... *A47C 3/029* (2013.01); *A47C 3/34* (2013.01)

(58) Field of Classification Search
CPC .. A47C 3/029; A47C 3/02; A47C 3/34; A47C 3/20; A47C 16/04; A47C 16/025; A47C 16/02
USPC ..... 297/259.1, 258.1
See application file for complete search history.

(56) References Cited

U.S. PATENT DOCUMENTS 4,328,991 A * 5/1982 Mengshoel ..... A47C 9/005 297/271.1
4,650,249 A * 3/1987 Serber ..... A47C 9/005 297/313
4,786,105 A * 11/1988 Sheehan ..... A47C 3/029 297/271.6
4,960,305 A * 10/1990 Opsvik ..... A47B 39/08 297/423.12
5,112,103 A * 5/1992 Downer ..... A47C 3/029 297/188.12
5,782,532 A * 7/1998 Opsvik ..... A47C 3/20 297/338
8,845,023 B2 * 9/2014 Chen ..... A47D 13/102 297/258.1
D855,368 S * 8/2019 Mengshoel ..... D6/716.1
2016/0286966 A1 * 10/2016 Sutherland ..... A47C 9/002

* cited by examiner

*Primary Examiner* — Mark R Wendell
(74) *Attorney, Agent, or Firm* — Klarquist Sparkman, LLP

(57) ABSTRACT

A balancing chair can comprise a support structure, the support structure comprising a top portion, a middle portion, and a bottom portion, wherein the top portion is coupled to a first pad and a second pad, the second pad resting between the first pad and the middle portion, and a base, comprising a first lateral runner and a second lateral runner, the first and second lateral runners coupled to and perpendicular to the bottom portion of the support structure, wherein the first lateral runner and the second lateral runner have first and second lower surfaces, respectively, that collectively define a lower curved surface of the base, the lower curved surface enabling the base to define a rocking motion from side to side.

20 Claims, 4 Drawing Sheets

ACTIVE SEATING APPARATUS

FIELD

This disclosure relates to ergonomic chairs which promote active sitting.

BACKGROUND

Ergonomic furniture has long been recognized for its benefits in counteracting certain negative side effects of sedentary living and working conditions. More specifically, ergonomic chairs have been known to help individuals maintain good posture, spinal health, and productivity. However, conventional designs in this field have failed to address certain inadequacies and limitations of preexisting models and therefore, further innovation to overcome this stagnation is needed.

SUMMARY

According to one aspect of the disclosed apparatus, a balancing chair includes a support structure, the support structure comprising a top portion, a middle portion, and a bottom portion, wherein the top portion is coupled to a first pad and a second pad, the second pad resting between the first pad and the middle portion, and a base, comprising a first lateral runner and a second lateral runner, the first and second lateral runners coupled to and perpendicular to the bottom portion of the support structure, wherein the first lateral runner and the second lateral runner have first and second lower surfaces, respectively, that collectively define a lower curved surface of the base, the lower curved surface enabling the base to define a rocking motion from side to side.

According to another aspect of the disclosed apparatus, a balancing chair includes a central support structure, the central support structure comprising an upper portion, a lower portion, and a middle portion, wherein the lower portion is coupled to a base, the base comprising at least one curved surface, wherein the at least one curved surface enables the base to move laterally side to side along the at least one curved surface, a first pad defining a user seat and coupled to the upper portion of the central support structure, and a second pad defining a knee support and coupled to the central support structure between the first pad and the middle portion, wherein the second pad comprises an adjustment assembly, the adjustment assembly enabling the second pad to be vertically adjusted along the central support structure, wherein the second pad remains at a constant angle relative to the base at each vertical adjustment.

The foregoing and other objects, features, and advantages of the invention will become more apparent from the following detailed description, which proceeds with reference to the accompanying figures.

DETAILED DESCRIPTION

Figure 1:
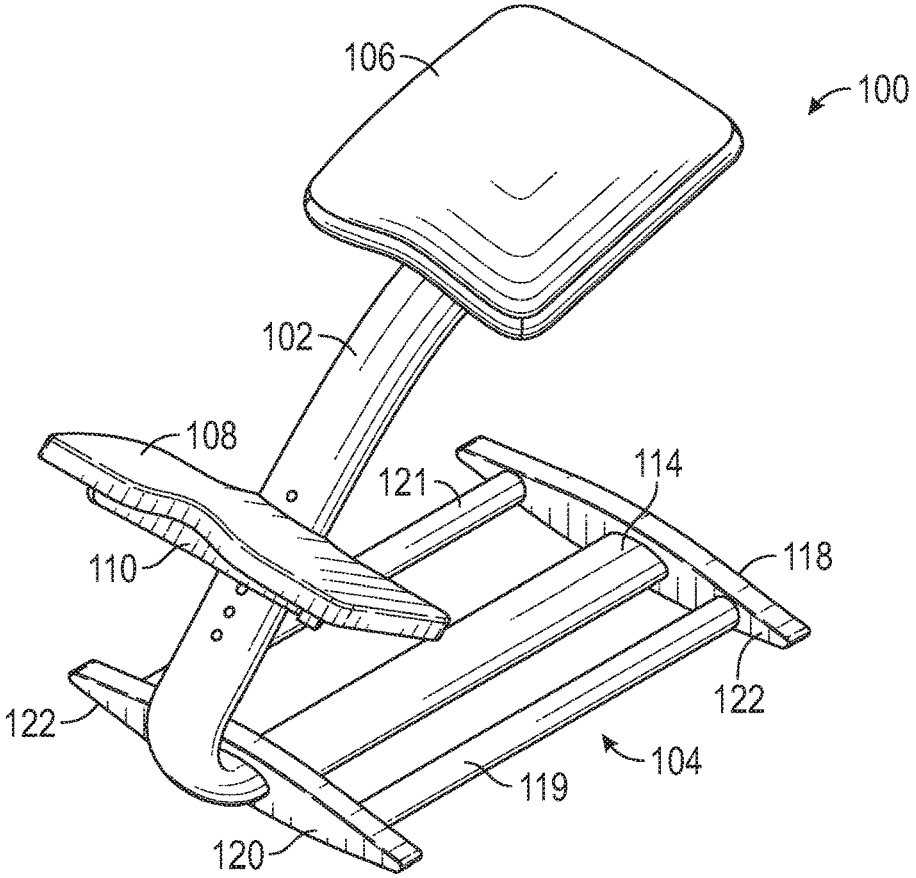
FIG. 1 is a perspective drawing of the balancing chair.

As used in this application and in this application and in the claims, the singular forms "a," "an," and "the" include the plural forms unless the context clearly dictates otherwise. Additionally, the term "includes" and "has" have the same meaning as "comprises." Further, the term "coupled" does not exclude the presences of intermediate elements between the coupled items.

The apparatus described herein should not be construed as limiting in any way. Instead, the present disclosure is directed toward all novel and non-obvious features and aspects of the various disclosed embodiments, alone an in various combinations and sub-combinations with one another. The disclosed apparatus is not limited to any specific aspect or feature or combinations thereof, nor does the disclosed apparatus require that any one or more specific advantages be present, or problems be solved. Any theories of operation are to facilitate explanation, but the disclosed apparatus is not limited to such theories.

A number of negative health effects are often linked to sedentary living. Many of these effects arise from poor posture due to sitting in standard home and office furniture, which urge users to form a 90° angle between their knees and torso. Sitting at or near a 90° angle for prolonged periods of time can place a significant amount of pressure on the spine, causing individuals to slouch, slump, and/or form an unhealthy curvature in the spine. Poor posture not only significantly increases the likelihood a person will experience depression, joint pain, inflammation, and/or potentially serious degenerative conditions, but it is also one of the leading causes of low productivity and disability worldwide in both children and adults.

Maintaining a healthy posture helps to counteract or prevent these harmful effects, but it also provides many benefits, including an increase in overall well-being, self-worth, confidence, concentration, energy, circulation, digestion, and breathing. One way of developing a healthy posture is by using a kneeling chair. Kneeling chairs utilize a forward leaning seat which eases the user's torso and hips forward and distributes weight more evenly. This forward lean encourages the user to engage their core muscles to sit in a proper lumbar supportive posture (known as "active sitting"), resulting in a reduction of pressure on the spine, inflammation, pain, and/or the potential development of other adverse conditions.

However, due to the outdated design of many conventional kneeling chairs, users are left motionless and unable to utilize important core muscles and/or are left with soreness in the knees and hips. For example, only a small fraction of preexisting kneeling chairs allow a user to move slightly forward and backward, while most provide no movement at all. This confinement ultimately restricts lateral movement and consequently, the use of inner and outer abdominal muscles crucial to balance and spinal stability as well as feelings of revival or refreshment often felt by those who engage in some form of movement while sitting. Further, many conventional kneeling chairs do not allow the user to properly adjust the knee pads independently from the seat. This limitation requires the user to alter the height and/or angle of the seat in order to adjust their position relative to the kneepad, which often results in discomfort and pain in the knees and hips. Due to the inadequacies of preexisting kneeling chairs, a chair which promotes overall well-being, user comfort, and encourages core muscle development through lateral movement is desirable for those seeking to counteract sedentary living.

Figure 2:
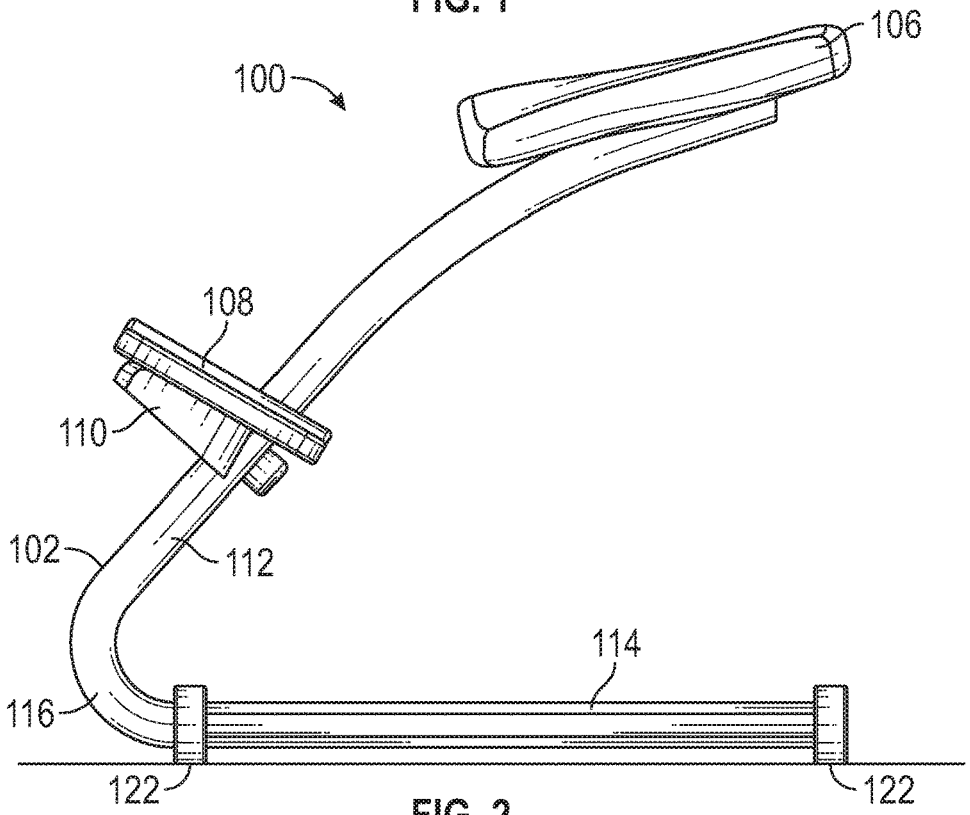
FIG. 2 is a side view of the balancing chair.

FIG. 1 and FIG. 2 show an embodiment of a balancing chair 100 that can be adapted for various uses, including as an office chair, in a dining room or living room, in a nursery, for meditation, in schools, etc. The balancing chair 100 can include a support structure 102 with a bottom portion 114 coupled to a base 104. The base 104 and/or support structure 102 can be constructed from a combination of suitable materials, including beechwood, oak, aluminum, steel, polymer, etc., and/or the support structure 102 can be a single, unitary structure.

The base 104 can include two or more lateral runners 118, 120, and one or more post members 119, 121 that extend therebetween. In some embodiments, the bottom portion 114 can be coupled to the two or more lateral runners 118, 120 by means of adhesive, screws, nuts and bolts, clamps, staples, and/or other appropriate means. The first lateral runner 118 and second lateral runner 120 can be parallel to one another, and perpendicular to the bottom portion 114 to collectively define a lower curved surface 122 spanning the width of the base 104. Thus, the lower curved surface 122 includes the ground-contacting surfaces of the base 104 as shown in FIG. 2.

In some embodiments, the lower curved surface 122 can be discontinuous along its length. For example, as shown in FIG. 1, the first and second lateral runners 118, 120 collectively define a discontinuous lower curved surface. In other embodiments, one or more intermediate lateral runners can be provided. For example, a third lateral runner with a similar structure to those of the first and second lateral runners 118, 120 can be provided at a midpoint between the first and second lateral runners 118, 120. In that case, the lower curved surface 122 would be collectively defined by the ground-contacting surfaces of the three lateral runners.

In other embodiments, the base 104 can comprise a single lateral runner extending the length of the base 104. Thus, for example, the first lateral runner 118 can extend from the first end to the second end of the base 104 (i.e., extending to and encompassing second lateral runner 120 to form a single lateral runner).

Figure 5:
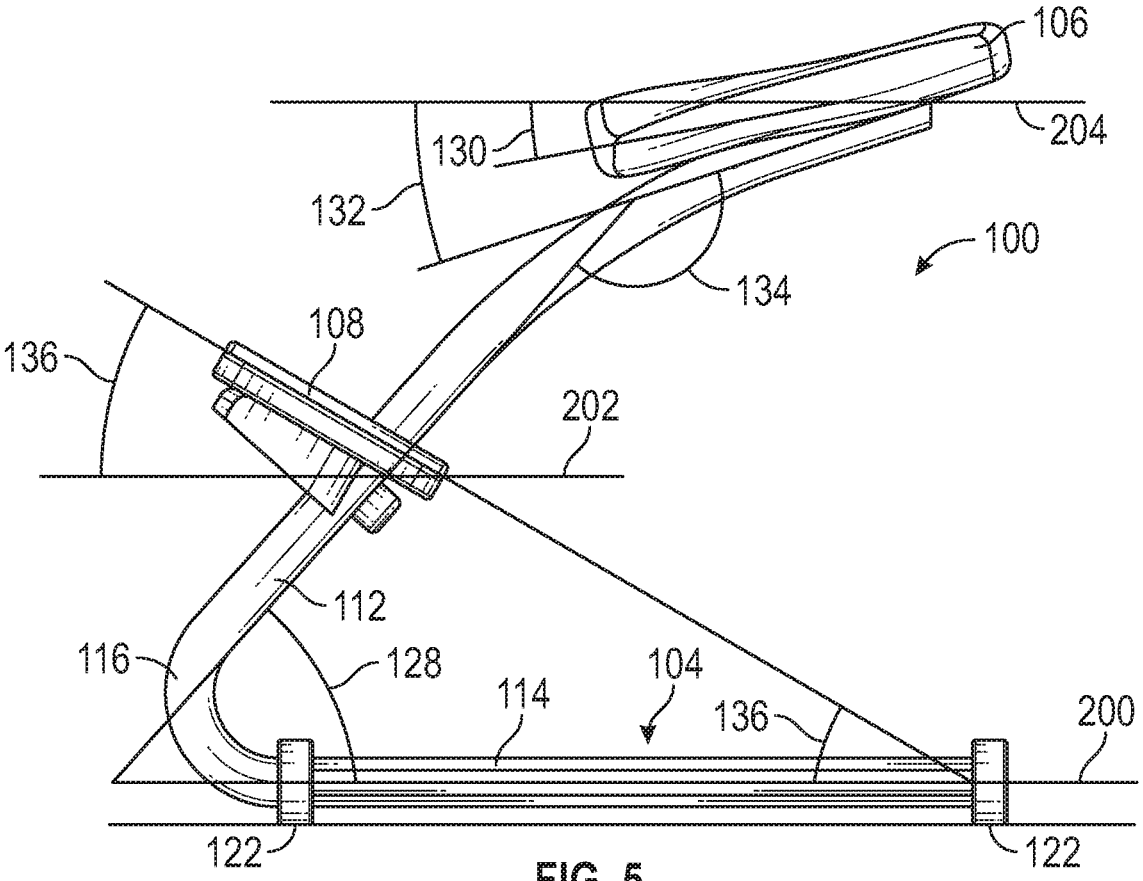
FIG. 5 is another side view of the balancing chair.

As shown in FIG. 5, the top portion 112 of the support structure 102 can form an angle 128 relative to a lower horizontal plane 200. For example, when the balancing chair 100 is in a neutral position on a supporting surface (e.g., a ground surface), the lower plane 200 is defined by a central, horizontal axis through the base 104, which is parallel to the ground. In some embodiments, an angle 128 is formed between horizontal plane 200 and an adjacent area of top portion 112, as shown in FIG. 5. Angle 128 can be between 40° and 55°, or between 45° and 50°, relative to the lower plane 200 of the base 104.

Additionally, FIG. 1 and FIG. 2 shows that the balancing chair 100 can include a first pad 106 coupled to the top portion 112 of the support structure 102 by appropriate means, such as adhesive, screws, nuts and bolts, clamps, staples, etc. The first pad 106 defines a user seat and can be formed in any desirable shape such as a cylinder, rectangular prism, custom mold, etc.; made from any suitable material including beachwood, etc.; and/or can include upholstery. In some embodiments, the first pad 106 is a saddle seat meant to open the angle between the user's hips and knees, to promote better posture and spine curvature.

As shown FIG. 5, the first pad 106 can be coupled to the top portion 112 at a downward angle 130 relative to a horizontal upper plane 204 (which is parallel to the lower plane 200). The downward angle 130 is defined by the horizontal upper plane 204 and a central axis that extends from a front portion to a rear portion of the first pad 106. In some embodiments, the downward angle can be between 5° and 20°. In other embodiments, the downward angle can between 10° and 15°.

Further, FIG. 5 shows that a segment of the top portion 112 can extend at an angle 132 relative to the upper plane 204. Angle 132 can be an angle between 10° and 30°, or between 15° and 25°. Another angle 134 can be formed along the length of the top portion 112, as shown in FIG. 5. This arrangement can effectively prompt users to tip their torso and hips forward to a more ergonomic sitting position. For example, in some embodiments, the user's seated position can desirably form an angle of about 100° to 140° between the user's legs and torso, encouraging the user to engage their core muscles in the desired activated sitting posture.

The balancing chair 100 also includes a second pad 108, defining a knee support and coupled to the support structure 102 between the first pad 106 and a middle portion 116 as illustrated in FIG. 1 and FIG. 2. As the user sits on the first pad 106, the user rests their knees or shins against the second pad 108, distributing their weight and allowing them to securely lean forward and achieve proper lumbar curvature. In some embodiments, the second pad 108 can include a high-density foam cushion, polypropylene mesh material, rubber, wood, water repellant upholstery or other appropriate material to provide comfort and/or utility.

In some embodiments, the second pad 108 of the balancing chair 100 is coupled to an adjustment mechanism 110 that allows the second pad to be independently adjusted vertically along a length of the support structure 102 (i.e., to vary the height of the second pad relative to the ground). By this arrangement, the second pad 108 can be adjusted to vary the distance between the first pad 106 and the second pad 108.

Figure 4:
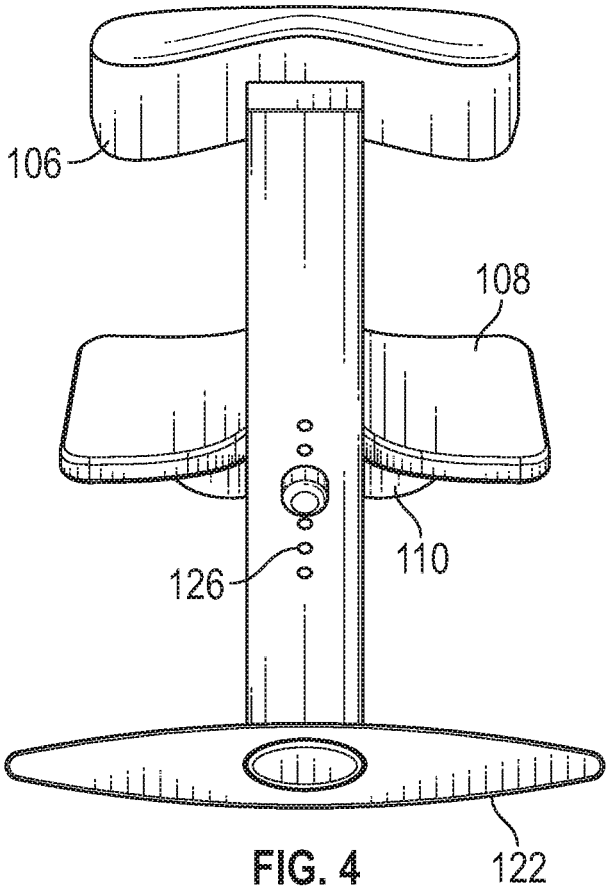
FIG. 4 is a back view of the balancing chair.

The adjustment mechanism 110 can comprise a securing structure, such as a biasing pin or other securing member, that is configured to engage with openings 126 of the top portion 112, as shown in FIG. 4. The openings 126 can extend partially or completely through the support structure 102. This independent vertical motion of the second pad 108 enables the user to adjust the spacing between the first and second pads 106, 108 to accommodate leg positioning and spacing. Additionally, the vertical motion allows the first pad 106 and the second pad 108 to keep their respective angles no matter the vertical positioning of the second pad 108, encouraging consistent lumbar curvature despite the user's body type.

In some embodiments, as shown in FIG. 5, the second pad 108 rests at an upward angle 136 between 20° and 40° relative to a horizonal plane 202 (and lower plane 200), with horizontal plane 202 being parallel to both the lower plane 200 and upper plane 204. In other embodiments, the second pad 108 can rest at an angle 136 between 25° and 35°, or between 28° and 32°.

Figure 3C:
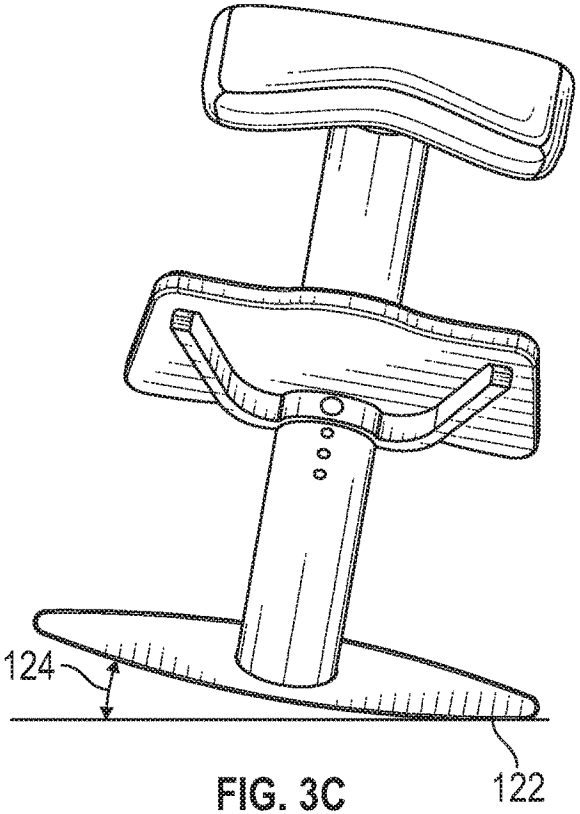
FIGS. 3A-3C are front views of the sequential movement of the balancing chair.
Figure 3B:
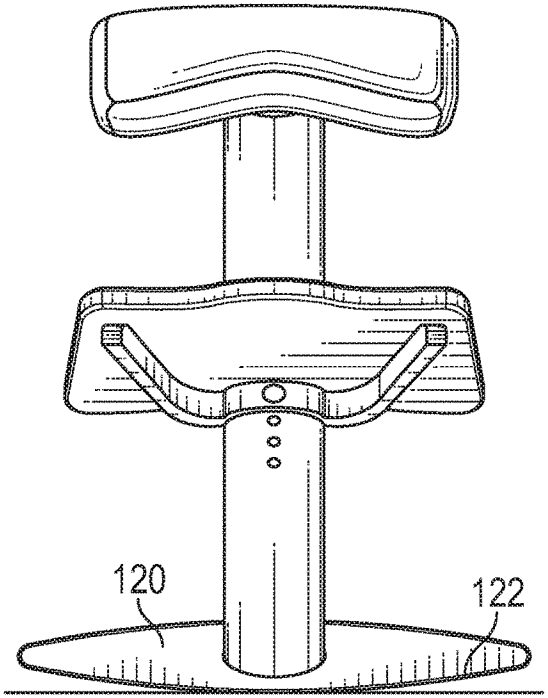
Figure 3A:
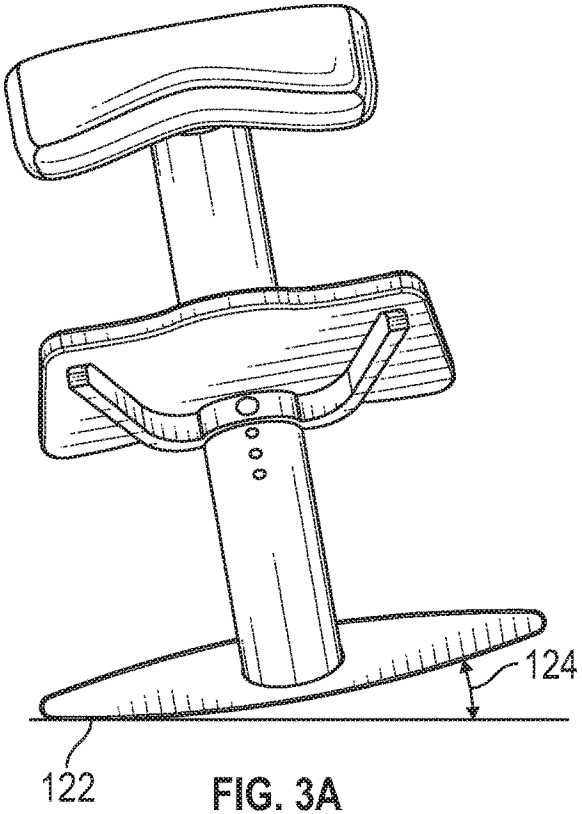

FIGS. 3A-3C illustrates the balancing chair's 100 ability to move from side-to-side, due to the lower curved surface 122. This feature allows the user to rock side-to-side in sporadic and/or periodic intervals in varying angles 124, allowing the user to move laterally between a neutral position (i.e., 0°) and a maximum leaning position (e.g., on both sides). In some cases, the maximum leaning position has a maximum angle 124 of 30°. In other cases, the maximum angle 124 is 25°, 20°, or 15°. In use, for example, the user may move laterally between 0° and 30° in some cases, and between 0° and 25°, 0° and 20°, or 0° and 15° in other cases, from the balancing chair's 100 resting, or neutral, position.

The side-to-side lateral movement provides the user personal freedom of movement and prompts them to utilize their inner abdominals such as the transversus abdominus, the internal oblique fibres, and the fibres of the quadratus lumborum, which function to stabilize spinal joints as well as control position, balance, and movement. It will be appreciated that as the balancing chair 100 moves laterally from side to side, other features including the support structure 102, first pad 106, second pad 108, and the planes 200, 202, 204 remain fixed relative to the base 104, which renders the user in total control of the motion to provide optimum benefits.

Furthermore, as shown in FIG. 2, the balancing chair 100 can sit flush with a ground surface to permit minimal or no movement forward and backward. As the balancing chair 100 moves from side-to-side, at least a portion of the lower curved surface 122 can be in consistent contact with the ground surface. In some embodiments, the base 104 is wider than the second pad 108, while the second pad 108 is wider than the first pad 106, to increase user stability and comfort due to the increasing width down the chair.

In view of the many possible embodiments to which the principles of the disclosed apparatus may be applied, it should be recognized that the illustrated embodiments are only preferred examples of the invention and should not be taken as limiting the scope of the invention. Rather, the scope of the invention is defined by the following claims. I therefore claim as my invention all that comes within the scope and spirit of these claims.

I claim:

1. A balancing chair comprising:

a support structure, the support structure comprising a top portion, a middle portion, and a bottom portion, wherein the top portion is coupled to a first pad and a second pad, the second pad resting between the first pad and the middle portion; and a base, comprising a first lateral runner and a second lateral runner, the first and second lateral runners coupled to and perpendicular to the bottom portion of the support structure, wherein the first lateral runner and the second lateral runner have first and second lower surfaces, respectively, that collectively define a lower curved surface of the base, the lower curved surface enabling the base to define a rocking motion from side to side.

2. The balancing chair of claim 1, wherein the second pad comprises an adjustment mechanism, the adjustment mechanism enabling the second pad to be independently adjusted along a length of the support structure.

3. The balancing chair of claim 2, wherein the support structure comprises at least two openings, the at least two openings being configured to engage with the adjustment mechanism of the second pad.

4. The balancing chair of claim 1, wherein the lower curved surface enables the base to move laterally between 0° and 30° on either side of a neutral position.

5. The balancing chair of claim 1, wherein the curved lower surface of the first lateral runner and second lateral runner extends a width of the base.

6. The balancing chair of claim 1, wherein the top portion and the bottom portion form an angle therebetween that is between 40° and 55°.

7. The balancing chair of claim 1, wherein the second pad rests between 20° and 40° relative to the base.

8. The balancing chair of claim 1, wherein the base is wider than the second pad and the second pad is wider than the first pad.

9. The balancing chair of claim 1, wherein the base has a length greater than its width.

10. The balancing chair of claim 1, wherein the support structure is fixed relative to the base.

11. The balancing chair of claim 1, wherein the support structure comprises a first arc and a second arc, the first arc positioned between the first pad and the second pad, and the second arc positioned along the middle portion, wherein the inner angle of the second arc is less than the inner angle of the first arc.

12. A balancing chair comprising:

a central support structure, the central support structure comprising an upper portion, a lower portion, and a middle portion, wherein the lower portion is coupled to a base, the base comprising at least one curved surface, wherein the at least one curved surface enables the base to move laterally side to side along the at least one curved surface;

a first pad defining a user seat and coupled to the upper portion of the central support structure; and a second pad defining a knee support and coupled to the central support structure between the first pad and the middle portion, wherein the second pad comprises an adjustment assembly, the adjustment assembly enabling the second pad to be vertically adjusted along the central support structure;

wherein the second pad remains at a constant angle relative to the base at each vertical adjustment.

13. The balancing chair of claim 12, wherein the adjustment assembly couples with one or more openings along the central support structure.

14. The balancing chair of claim 12, wherein the at least one curved surface has a length equal to and is perpendicular to the lower portion of the central support structure.

15. The balancing chair of claim 12, wherein the second pad rests at an angle between 20° and 40° relative to the base.

16. The balancing chair of claim 12, wherein a width of the first pad is less than a width of the second pad, and the width of the second pad is less than a width of the base.

17. The balancing chair of claim 12, wherein the at least one curved surface is discontinuous along a length of the lower portion of the central support structure.

18. The balancing chair of claim 12, wherein the second pad is removable from the central support structure.

19. The balancing chair of claim 12, wherein the first pad defining a user seat is coupled to the central support structure at a downward angle between 5° and 20°.

20. The balancing chair of claim 12, wherein the at least one curved surface enables lateral movement between 0° and 30° on either side of a neutral position.

* * * * *